US008281934B1

(12) United States Patent
Connolly et al.

(10) Patent No.: US 8,281,934 B1
(45) Date of Patent: Oct. 9, 2012

(54) SCREEN PANEL RETAINER SYSTEM

(75) Inventors: James D. Connolly, Princeton, WV (US); Tracy Leonard Lane, Princeton, WV (US)

(73) Assignee: Conn-Weld Industries, Inc., Princeton, WV (US)

( * ) Notice: Subject to any disclaimer, the term of this patent is extended or adjusted under 35 U.S.C. 154(b) by 0 days.

(21) Appl. No.: 13/049,000

(22) Filed: Mar. 16, 2011

(51) Int. Cl.
*B07B 1/49* (2006.01)

(52) U.S. Cl. ..... 209/405; 209/392; 209/393; 209/409

(58) Field of Classification Search ..... 209/363, 209/404, 405
See application file for complete search history.

(56) References Cited

U.S. PATENT DOCUMENTS

| | | | | |
|---|---|---|---|---|
| 4,840,728 | A | 6/1989 | Connolly et al. | |
| 5,112,475 | A | 5/1992 | Henry, Jr. | |
| 5,277,319 | A | 1/1994 | Henry, Jr. | |
| 5,398,817 | A | 3/1995 | Connolly et al. | |
| 6,206,200 | B1 * | 3/2001 | Gilles et al. | 209/399 |
| 6,964,341 | B2 | 11/2005 | Bacho et al. | |
| 7,717,269 | B2 * | 5/2010 | Bacho et al. | 209/399 |
| 7,946,428 | B1 * | 5/2011 | Lane et al. | 209/399 |
| 8,025,154 | B2 * | 9/2011 | Kriel | 209/405 |
| 2004/0074821 | A1 * | 4/2004 | Russell et al. | 209/405 |
| 2006/0175233 | A1 * | 8/2006 | Zubovich et al. | 209/680 |
| 2009/0301944 | A1 * | 12/2009 | Kriel | 209/405 |

* cited by examiner

*Primary Examiner* — Terrell Matthews
(74) *Attorney, Agent, or Firm* — Mattingly & Malur, P.C.

(57) ABSTRACT

A screen panel retainer assembly, that is utilizable with a vibrating separatory machine, is configured with a plurality of discrete, mushroom-shaped screen panel retainers. Each such retainer has a retainer head that is generally in the shape of a portion of a cylinder, such as a right cylinder. A shank connects each such retainer head to a suitable retainer bar. The retainer bar can be adapted to be attached either to screen stringer tubes of the vibrating separatory machine, or to underlying cross tubes and end cross tubes. The screen panels, which are to be secured to the vibrating separatory machine, have complementary shaped mushroom-shaped screen panel retainer head receiving chambers in their side surfaces. Two such panel edges define a whole chamber. The retainer heads are metal whereas the screen panel edges are resilient. The mushroom-shaped heads securely snap into their complementary chambers yet can be removed from those chambers when the screen panels have to be replaced.

20 Claims, 14 Drawing Sheets

SCREEN PANEL RETAINER SYSTEM

FIELD OF THE INVENTION

The present invention is directed generally to a screen panel retainer system. More particularly, the present invention is directed to a screen panel retainer system for use in securing and retaining screen panels on a vibrating separatory device. Most specifically, the present invention is directed to a screen panel retainer system that is usable to releasably retain screen panels on underlying supports of a vibrating separatory machine. A plurality of metal retainer bars are attachable to the underlying supports of the vibrating separatory machine frame. Each such metal retainer bar is provided with spaced, upwardly projecting, generally mushroom-shaped screen panel retainers. The retainers are rigid and are shaped to be receivable in cooperatively shaped retainer receiving chambers in either urethane screen panel edges or profile wire screen panel edges. The metal retainer bars are configured to be compatible with a variety of separatory machine frames and this allows the screen panel retainer system to be utilized with a wide variety of machine decks.

BACKGROUND OF THE INVENTION

Vibrating and other separatory screen assemblies are generally known in the art and are very useful in accomplishing the separation of materials, on the basis of the size of the materials to be separated. A slurry of liquid and entrained solids can be caused to run or to flow across an upper surface of a screen panel assembly. Particles of at least a certain size will not pass through apertures in the screen panels and will thus be separated out of the slurry. The screen panel assembly is caused to vibrate by a suitable vibratory drive, with this vibratory motion being beneficial in facilitating the proper separation of the slurry which is directed onto the screen panel.

One such vibrating separatory screen panel assembly: is shown in U.S. Pat. Nos. 5,112,475 and 5,277,319, both to Henry, and both assigned to Conn-Weld Industries, the assignee of the present application. In those two patents, there is disclosed a screen panel mounting system for a vibrating screen assembly. They is also disclosed a screen panel which is securable in the vibrating screen assembly by using the panel mounting system. A plurality of screen panels are secured to a panel deck of a frame portion of a vibrating screen assembly. A plurality of elongated hold downs or center retainers, which are made of a resilient elastomeric material, such as polyurethane, are provided with integral spaced anchoring pins along their bottom surface. Those integral, spaced anchoring pins are receivable in apertures in an anchor member. Once the hold down members or center retainers have been secured to the anchor member, which is, in turn, attached to spaced cross members or tubes of the frame of the vibratory separator, the screen panels are placed atop the panel deck with their side edges in contact with the center retainers. Elongated key members are inserted into upwardly facing slots in the center retainers to spread wing portions of the retainers laterally outwardly. This spreading of the wings of the center retainers causes the wings to grip the side edges of the screen panels so that these panels are secured in the vibrating screen assembly.

A center retainer assembly for a panel mounting system is disclosed in U.S. Pat. No. 5,398,817 to Connolly et al. which is also assigned to Conn-Weld Industries. The center retainer assembly described in the '817 patent utilizes an elongated bolting bar which is encased in a resilient material and which includes an elongated center retainer. The center retainer assembly of this patent is placed into an upwardly facing retainer channel and is secured to the retainer channel by placement of the bolts carried by the bolting bar through holes in the retainer channel. The retainer channel is, in turn, secured to mounting plates that are attached to a cross tube or to a cross bar of a vibrating screen assembly.

A more recent screen panel retainer system is described in U.S. Pat. No. 6,964,341 to Bacho et al. That patent is also assigned to Conn-Weld Industries, the assignee of the subject patent application. In that system, the screen panels are held in place by screen panel edge strips which have pockets on their undersurfaces. Those pockets are cooperatively shaped to receive a plurality of ears that are situated on upper surfaces of retainer bars. Those retainer bars are connected to the underlying deck stringer tubes.

A snap lock separatory panel and retainer system is disclosed in U.S. Pat. No. 7,717,269, also to Bacho et al., and also assigned to Conn-Weld Industries, Inc. In that patent there is disclosed a snap lock separatory panel retainer system as well as a separatory panel which is usable with the retainer system. Elongated locking strips are used to engage locking profiles on the separatory screen panels. Those locking strips utilize undercut receptacles to receive enlarged heads of retainer pins that are formed integrally with center retainer strips. Those center retainer strips are, in turn, secured to the deck stringer tubes that are typically provided in vibrating separatory machines. The locking strips are snap locked onto the center retainer by the engagement of the enlarged heads of the retainer pins in the cooperatively shaped undercut receptacles in the locking strips.

The various screen panel retainer systems, as described and depicted in the several Conn-Weld Industries patents and applications discussed above, have all enjoyed some degree of success in the industry. However, each has its individual limitations which have made each system less than suitable for use in all equipment, regardless of manufacturer and configuration. Several of the earlier systems required modification or reworking of the industry standard deck stringer tubes. Others, such as the system described in the Bacho et al. U.S. Pat. No. 6,964,341 have been found somewhat difficult to use and have required the provision of screen panel edge strips that have had to be field-installed on the replacement screen panels. Adjacent screen panels have sometimes required the use of cooperating and abutting screen panel edge strips. The abutment and alignment of these screen panel edge strips has been somewhat difficult to obtain in the field. This has increased the time that is required to both initially install the prior systems and to then replace worn screen panels with replacement screen panels. When a machine, which is operating in an industrial setting, must be taken out of service for repair or replacement of essential elements, that is a loss of that machine's production capacity. Such losses need to be kept at a minimum.

Several of the prior screen panel securement arrangements have required numerous parts and have been expensive to make and install. As discussed above, when a production machine is taken out of service, money is lost. It is thus imperative that the screen panel retainer system be relatively simple, having a limited number of components, that it be quick and easy in its installation, and universal in its ability to adapt to all of the various vibrating separatory machines that are used in the industry. Various machines utilize deck stringer tubes that are secured atop machine cross frame tubes which are frame components of the vibrating separatory machines. The deck stringer tubes are typically 2"×2" hollow steel tubes and are provided with mounting holes spaced along an upper surface of each such deck stringer tube at a spacing distance of 4". Other machines are provided with angle iron members that are secured to the cross members of the vibrating separatory machine. The screen panel retainer system must be adaptable for use with the diverse separatory machines that are currently in use.

A vibrating separatory machine uses an array of screen panels to separate solid materials from a slurry. The screen panels are situated in an array that typically utilizes a plurality of screens abutting each other, or adjacent to each other both in a direction of material flow and also in a direction that is traverse to the material flow direction. It is the exposed surface area of these screen panels which accomplishes the material separation. The greater the amount of exposed screen surface, the greater capacity for material separation the machine will have. In some of the prior systems, both those made by the assignee of the subject application, and by others, the retainer structures have tended to cover over substantial portions of the sides or edges of adjacent ones of the screen panels. While that reduction in available screen surface area may amount to only 5% of the total screen surface area, that is still 5% of the total screen surface area which is no longer available for accomplishing the machine's primary objective of separation of solids from a slurry. Any increase in open screen area will improve the operating characteristics of the vibrating separatory machine that uses the screen panel center retainer system of the present invention.

It will thus be understood that a need exists for a screen panel retainer system which overcomes the limitations of the prior systems, which is easily installed and operable, which is adaptable to various deck stringer tubes and machine frame machine cross frame tubes and which does not obstruct open screen area. The screen panel retainer system, in accordance with the present invention, overcomes the limitations of prior art and is a substantial advantage over the presently available systems.

SUMMARY OF THE INVENTION

It is an object of the present invention to provide a screen panel retainer system.

Another object of the present invention is to provide a screen panel retainer system that uses a minimum number of components.

A further object of the present invention is to provide a screen panel retainer system that is usable with a number of vibrating separatory machines.

Still another object of the present invention is to provide a screen panel retainer system which does not reduce the working surface areas of the screen panels with which it is used.

Yet a further object of the present invention is to provide a screen panel retainer system which is easy to use and which is cost effective.

As will be described in the detailed description of the preferred embodiments, the screen panel retainer system in accordance with the present invention utilizes a screen panel retainer bar that carries a plurality of generally mushroom-shaped screen panel retainers. Individual such mushroom-shaped screen panel retainers are spaced apart from each other along the length of each retainer bar. The retainer bars and their associated mushroom-shaped screen panel retainers are made of metal. Each retainer bar is configured so that it can be attached to the machine frame of the vibrating separatory machine with which it will be used. In machines that are constructed with deck stringer tubes attached to the machine cross frame tubes, the screen panel retainer bar is generally in the form of a horizontally oriented flat metal strip having an upper planar surface to which the mushroom-shaped screen panel retainers are attached. This horizontally oriented retainer bar is provided with spaced mounting studs that are receivable in the spaced bores in the deck stringer tubes. Appropriate fasteners are utilized to secure the retainer bars, and specifically their studs, to the deck stringer tubes. In other vibrating separatory machines, there are no deck stringer tubes. Each of the machine frame machine cross frame tubes may be provided with one or more metal flanges or angle clips. The screen retainer bars, in this preferred embodiment, are vertically oriented flat metal strips having an upper thin edge to which the mushroom-shaped screen panel retainers are attached, such as by welding. These vertically oriented retainer bars or strips are then belted to the angle clips that are located on the machine frame machine cross frame tubes. Alternatively, the retainer bars can be welded to the frame machine cross frame tubes, either directly or by being welded to angle clips which can then be secured to the machine cross frame tubes.

Each retainer bar is provided with its arrangement of the plurality of spaced, generally mushroom-shaped screen panel retainers, as described generally above. Each such screen panel retainer has a somewhat mushroom or open umbrella-like appearance in cross-section. An enlarged retainer head of each mushroom-shaped screen panel retainer is generally semi-circular in transverse cross-section. A retainer shank is positioned generally at the middle of the head diameter. That shank is secured, by welding or by being integrally formed with, the retainer bar. Each mushroom-shaped screen panel retainer has a finite longitudinal length and is shaped to be receivable in edges of urethane screen panels or in resilient edge strips of profile wire screen panels. The screen panel edges or edge strips are molded with receptacles or chambers that will each receive one side of a mushroom-shaped retainer. Two abutting screen panels will each thus engage one half of the same mushroom-shaped retainer. The screen panel edges or edge strips are sufficiently flexible to deform during their cooperative engagement with the mushroom-shaped retainer heads. However, the panel edge or edge strips are also strong enough to securely hold the screen panels, when they have been attached to the machine deck frame.

When the screen panels are constructed using profile wires supported by transverse tie rods and attached edge strips, it is usual to also install cross dams and dam retainers. These dams act to increase the separation efficiency of the screen panels by causing turbulent flow. They also cover the transition from one screen panel to the next. The transverse dams are held in place by the dam retainers which are formed having downwardly projecting dam retainer feet. Those retainer feet are bifurcated and are configured to be complementary in shape to the mushroom-shaped retainer heads. The screen panel edge strips have appropriately spaced and shaped cutouts. These allow the dam retainer feet to pass through the upper portion of the screen edge bars and to engage the mushroom-shaped retainers.

Each of the horizontally oriented screen panel retainer bars is no wider than the width of the deck stringer tube to which it is attached and is also no wider than the urethane screen panel edges or the profile screen panel edge strips of two of the adjacent screen panels which it underlies. The separatory panels are not reduced, in their effective surface area, by the screen panel retainers. The cross dams and dam retainers, if they are required, do not reduce the usable screening surface of the vibrating separatory machines. The retainers, with their mushroom-shaped retainer heads, are easily installed on a variety of separatory machines. They do not require extensive machine modifications and are effective to securely, yet releasably, secure the screen panels to the machine deck.

The screen panel retainer system, in accordance with the present invention, is uncomplicated structurally and does not require a large number of diverse parts or pieces. It is capable of being installed on a variety of separatory machines with only a few components. The screens, which are attached to the machine deck, using this system, are held tightly in place yet can be readily removed for repair or replacement. The screen panel assembly in accordance with the present invention overcomes the limitations of the prior art and is a substantial advance in the area of vibrating separatory screen technology.

BRIEF DESCRIPTION OF THE DRAWINGS

While the novel features of the screen panel retainer system, in accordance with the present invention, are set forth with particularity in the appended claims, a full and complete understanding of the invention may be had by referring to the detailed description of the preferred embodiments, which is presented subsequently, and as illustrated in the accompanying drawings, in which:

DESCRIPTION OF PREFERRED EMBODIMENTS

Figure 1:
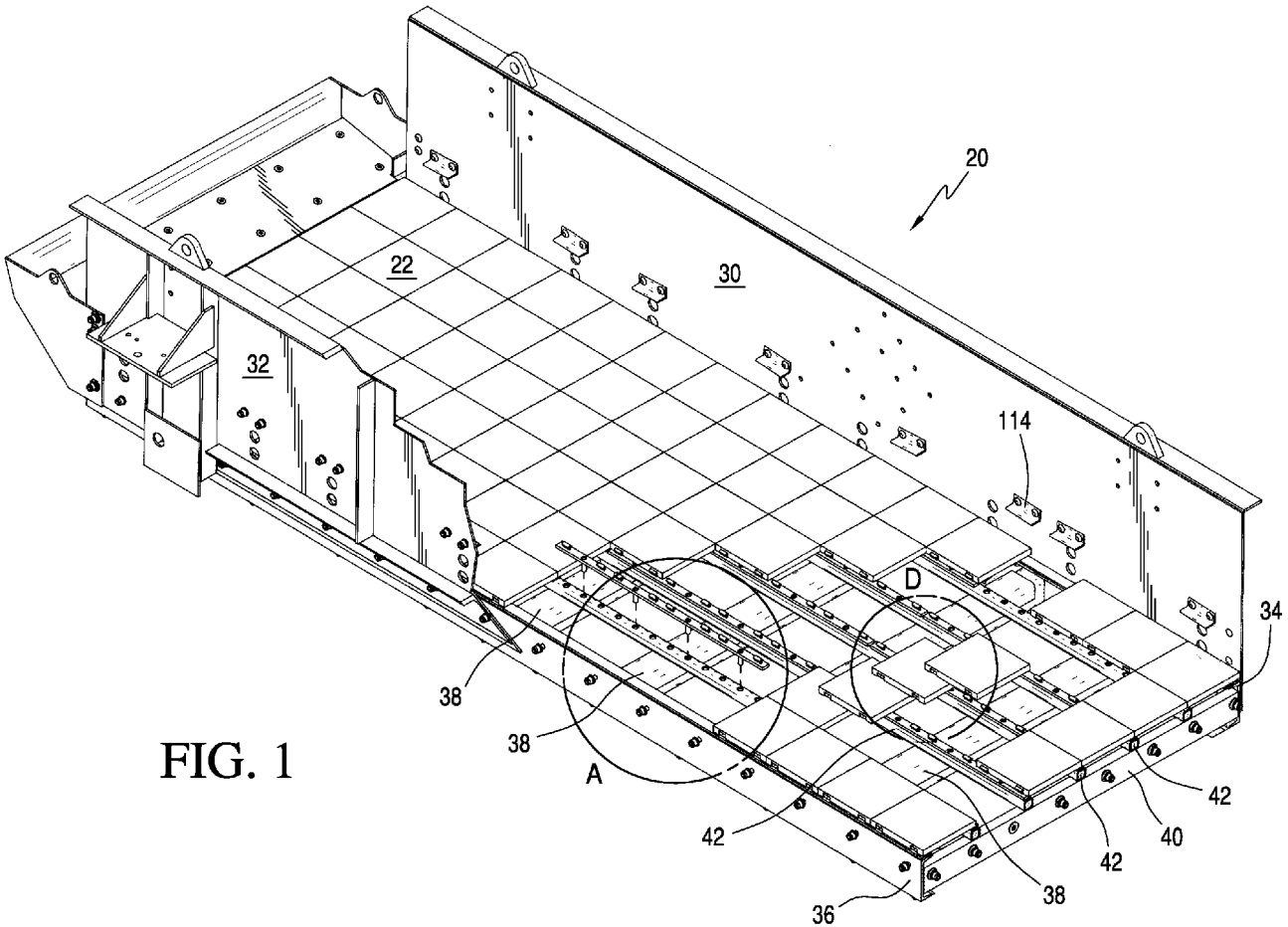
FIG. 1 is an exploded perspective view of a vibrating separatory machine and showing a first preferred embodiment of the screen panel retainer system being used to secure urethane screen panels to the machine deck of a vibrating separatory machine.

Referring initially to FIG. 1, there may be seen, generally at 20, a somewhat schematic depiction of a first variation of a vibrating separatory machine in which a first preferred embodiment of the screen panel retainer system in accordance with the present invention is being utilized. The vibrating separatory machine 20 depicted in FIG. 1 is intended to be representative of a class of such machines with which the present invention can be used. Such machines are manufactured by CONN-WELD INDUSTRIES, INC., the assignee of the subject application, as well as by other manufacturers. A more complete understanding of such equipment may be obtained by visiting the website of the assignee at www-.Conn-Weld.com. Such vibrating separatory machines are also described in assignee's prior U.S. Pat. Nos. 5,112,475; 5,398,817; 6,964,341; and 7,717,269, as well as in assignee's pending U.S. patent application Ser. No. 12/216,834, filed Jul. 11, 2008, the disclosures of all of which are expressly incorporated herein by reference.

As is well known in the industry, vibrating separatory machines, such as the one depicted at 20 in FIG. 1, are used to separate slurries of materials into their liquid and solid components. The slurry enters the machine generally at the upper left, as seen in FIG. 1, and flows downwardly and to the right. As the slurry flows across the surface of the separatory machine, it passes over an array of screen panels. These panels allow the liquidus material to flow through and out the bottom of the machine. The solidus material travels along the surface of the screen panels and is allowed to exit at the right, as depicted in FIG. 1.

The screen panels are typically one of two generally well known types. In FIG. 1, there are depicted, generally at 22, urethane screen panels. These panels are typically 12"×12" unitary panels that are provided with arrays of screening separatory compartments. This structure is described in greater detail in the above-recited U.S. Pat. No. 7,717,269 to which description one can refer for a more detailed discussion of the structure and operation of these urethane screen panels 22. Suffice it to say that these panels have openings which are sized to perform their desired separatory function.

Figure 6:
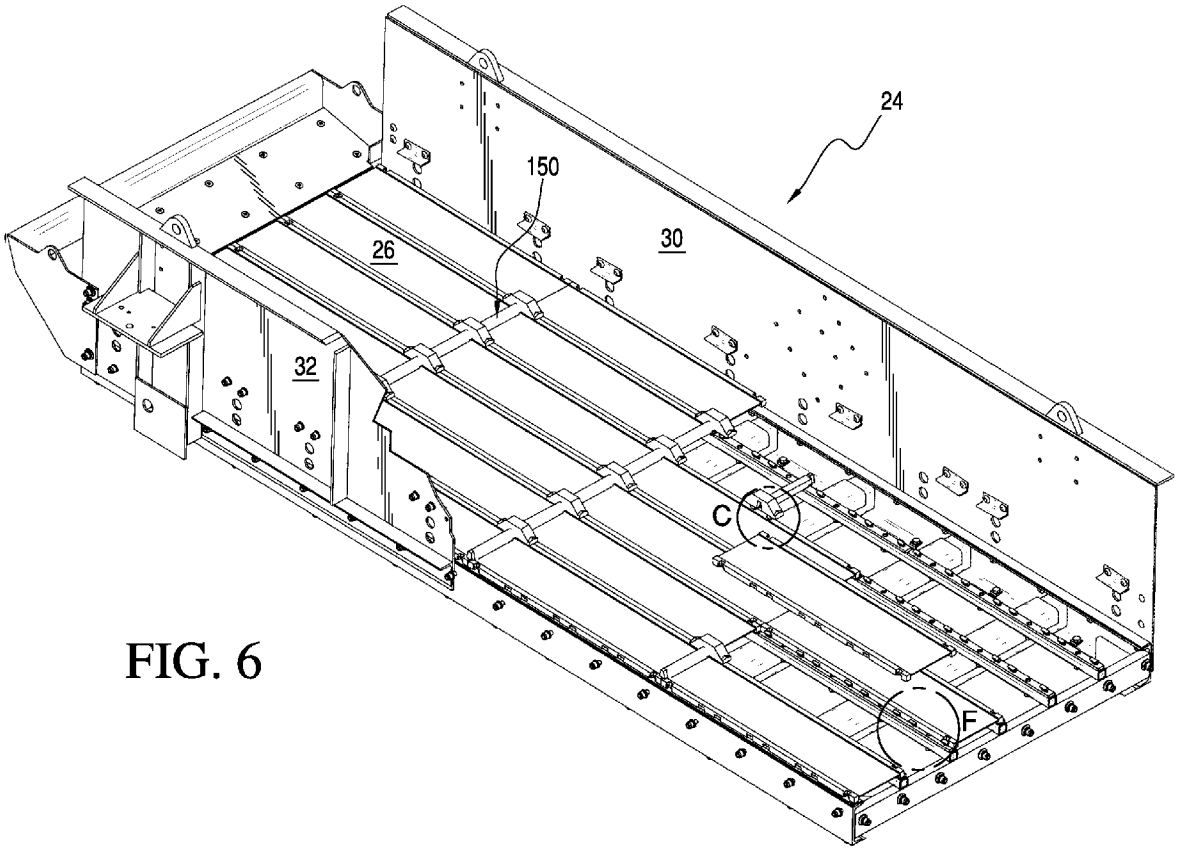
FIG. 6 is an exploded perspective view of a vibrating separatory machine and showing a plurality of profile wire screen panels secured to the machine deck using the first embodiment of the screen panel retainer system of the present invention.

FIG. 6 depicts, also somewhat schematically, and at 24, a second variation of a vibrating separatory machine. Both of the first and second variations 20 and 24 are essentially the same in overall structure and operation, as will be discussed in greater detail shortly. In the variation that is depicted somewhat schematically in FIG. 6, the separation of the slurry into its liquidus and solidus constituents is done using profile screen wire panels, generally at 26. These panels 26 are typically 1'×4' and are constructed of a plurality of parallel, elongated profile screen wires, which extend in the flow direction of the slurry and which are welded or otherwise attached to underlying, transverse tie rods. The ends of those tie rods are secured in flexible profile wire screen panel edge strips. A more complete description of these profile wire screen panels can be had by referring to assignee's previously indicated U.S. Pat. No. 6,964,341.

In both of the first and second variations of a vibrating separatory machine, as well as in a third variation, which is depicted generally at 28 in FIG. 10 and which will be discussed in detail shortly, the separatory panels, either the urethane panels 22 or the profile wire screen panels 26, are replaceable. As they separate the slurry into its two components, they are worn down by the abrasive nature of the slurry. In time, the separatory panels have to be removed and replaced. The subject invention is directed to a screen panel retainer system which will make the task of removal and replacement of the screen panels, either of the urethane type or of the profile screen wire type, less complicated, easier, and in a less time-consuming manner than has been possible using the various prior art systems and structures.

Referring again to FIG. 1, the vibrating separatory machine, generally at 20, is constructed using a pair of spaced, lateral side walls or panels 30; 32 which are connected, at their lower portion, to side panel channel iron frame members 34; 36. These lateral side panels 30; 32 and their associated channel iron frame members 34; 36 extend generally in the flow direction of the slurry to be separated, which, as was discussed above, is from left to right, as seen in FIG. 1. A plurality of machine cross frame tubes 38 extend between the channel iron frame members 34; 36. These machine cross frame tubes 38 are spaced, generally parallel to each other, and are generally transverse to the direction of slurry flow. A separate machine end cross frame tube 40 is located at each end of the vibrating separatory machine. The side panels 30; 32; the side panel channel iron frame members 34; 36; the machine cross frame tubes 38 and the machine end cross frame tubes 40 cooperate to define the overall frame structure of the vibrating separatory machine 20.

Figure 2:
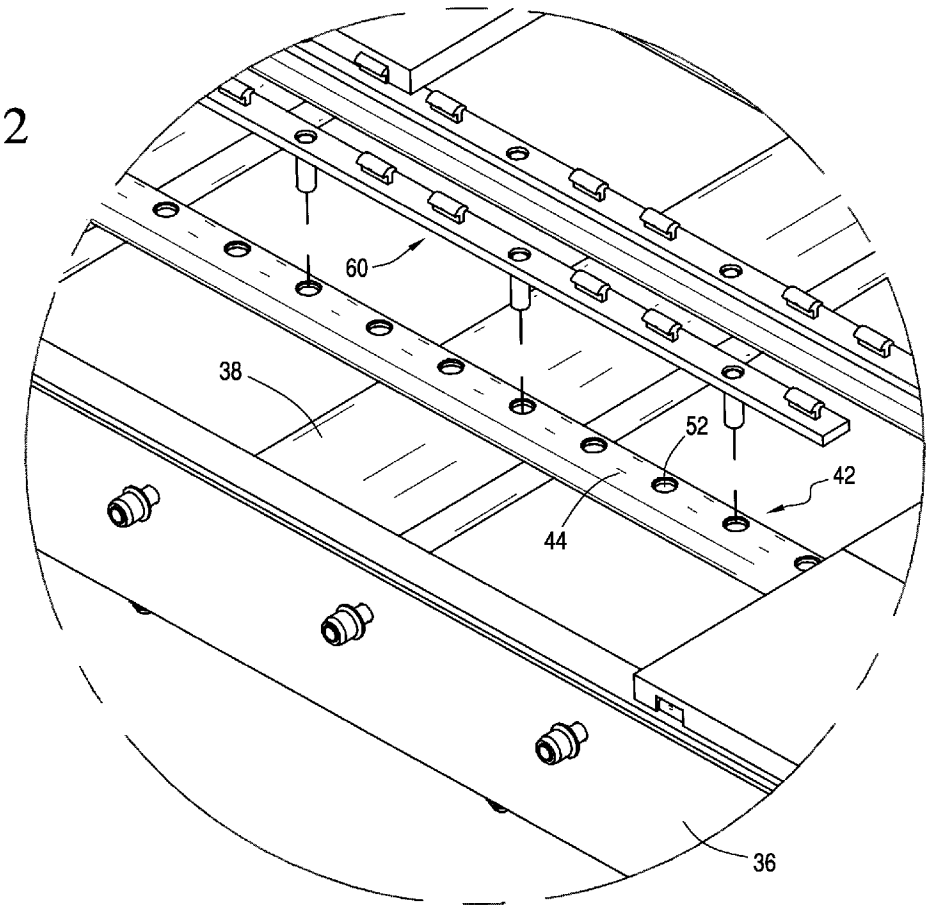
FIG. 2 is an enlarged perspective view of an encircled portion a of the device depicted in FIG. 1.
Figure 4:
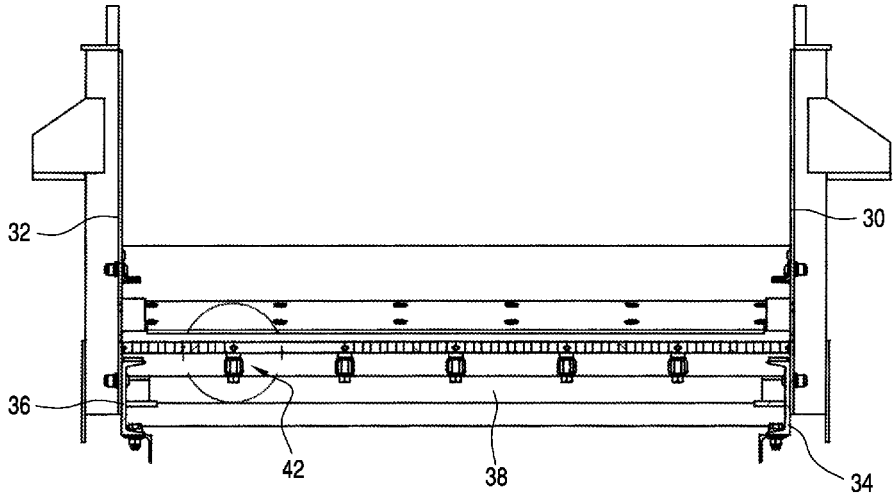
FIG. 4 is an end view of the vibrating separatory machine shown in FIG. 1.
Figure 5:
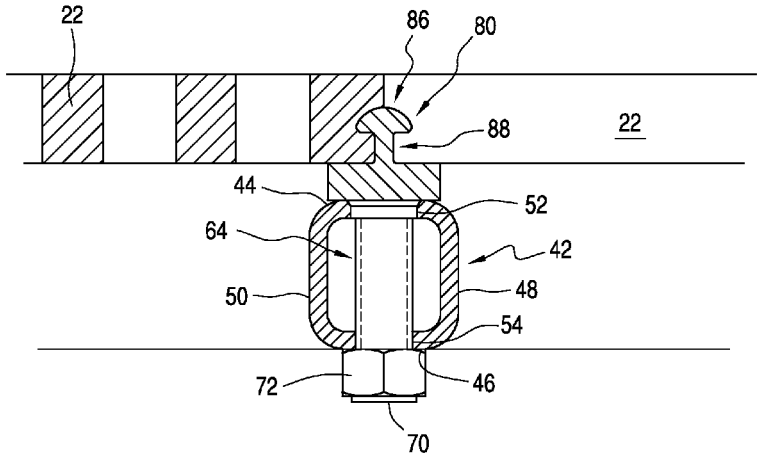
FIG. 5 is an enlarged view of the encircled portion of FIG. 4.

A plurality of deck stringer tubes, generally at 42, as seen in FIG. 1, and in more detail in FIGS. 2, 4, and 5, are secured to the machine end cross frame tubes 40 and to the spaced machine cross frame tubes 38. These deck stringer tubes 42 are spaced from each other and are parallel to the lateral side panels 30; 32 and to the side panel channel iron frame members 34; 36. As may be seen more clearly in FIG. 5, each deck stringer tube 42 is in the form of a metal tube, and preferably is a stainless steel tube that is approximately 2"×2" and which has a wall thickness of approximately ¼". As seen in FIGS. 2 and 5, each deck stringer tube has a top surface 44, a bottom surface 46, and spaced right and left side surfaces 48 and 50, respectively. A plurality of longitudinally spaced bores or holes 52 are spaced along the top surface 44 of each deck stringer tube 42. These top surface holes 52 are typically aligned with corresponding bottom surface holes 54. These holes 52 and 54 are spaced apart from each other at a conventional spacing distance, which may be, for example, 4" on center. The structure and hole spacing of these deck stringer tubes 42 has been standardized by the majority of the manufacturers of vibrating separatory machines.

Figure 18:
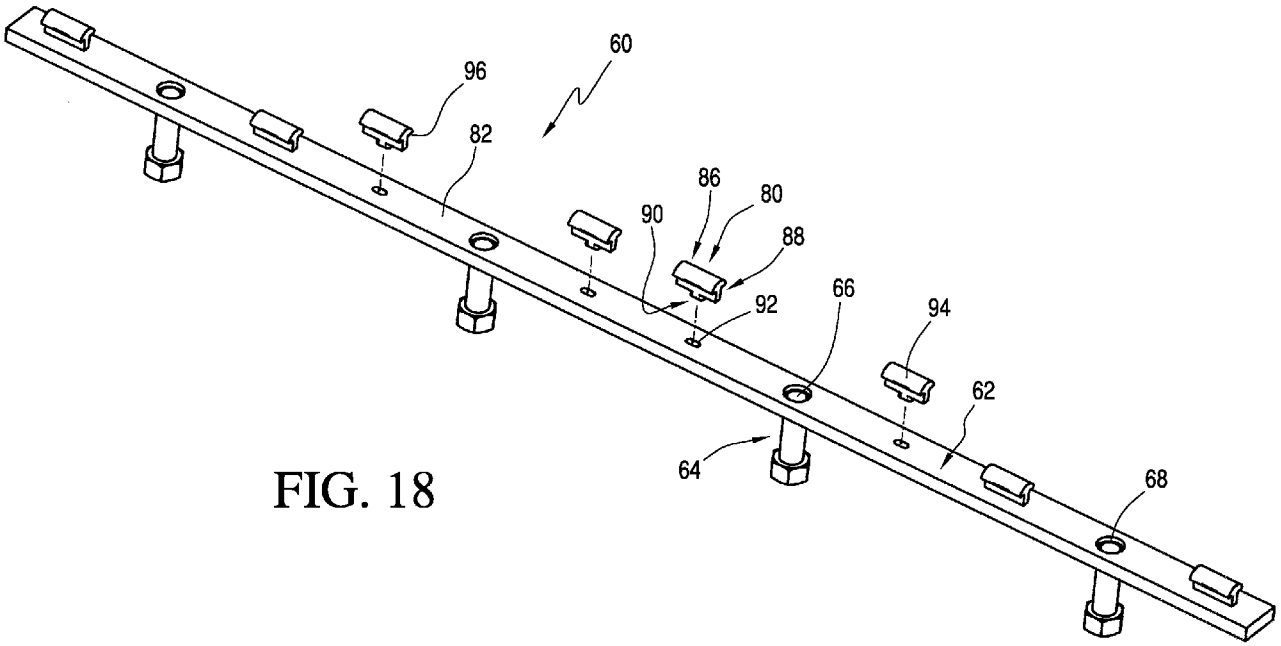
FIG. 18 is an exploded perspective view of the first preferred embodiment of the screen panel retainer in accordance with the present invention.

A first preferred embodiment of a screen panel retainer assembly in accordance with the present invention is depicted at 60, as may be seen most clearly in FIG. 2, and as is also seen by itself in FIG. 18. Referring initially to FIG. 18, the screen panel retainer utilizes an elongated metal retainer bar 62 that, in the preferred embodiment, is mild steel, has a width of approximately 1½", a thickness of ⅛" to ½", and is typically provided in lengths of 48". That metal retainer bar 62, in its first embodiment depicted in FIG. 18, is oriented generally horizontally. Its width is oriented in a horizontal plane. A plurality of downwardly extended studs 64 are secured, such as by welding, at their upper ends 66 into spaced bores 68 formed in the horizontal planar surface width of the elongated metal retainer bar 62. These spaced bores 68 and the studs 64 that they receive are preferably spaced at 12" intervals along each 48" section of the screen panel retainer bar 62. The positioning of these studs 64 is done in concert with the hole spacing of the top surface holes 52 and, if provided, the bottom surface holes 54 that are provided in each of the deck stringer tubes 42. These retainer bars 62 may be identified as deck stringer tube retainer bars 62.

As may be seen more clearly in FIG. 5, each stud 64 has a length such that a threaded lower shank 70 will extend sufficiently below the bottom surface 46 of the deck stringer tubes 42 to allow a nut 72 to be threaded onto it. In this way, the horizontally planar retainer bars 62 of the first preferred embodiment of the screen panel retainer assembly 60 in accordance with the present invention, can be securely yet removably attached to the spaced deck stringer tubes 42.

In some instances, the deck stringer tubes 42 do not have lower surface holes 46. In that case, the threaded studs 64 depicted more clearly in FIG. 18 can be replaced by the use of plugs, generally of the type identified at 90 in assignee's U.S. Pat. No. 7,717,269. Alternatively, the plugs 72 depicted in assignee's U.S. Pat. No. 6,964,341 can be utilized to positively secure the elongated metal retainer bar 62 of the present invention to the underlying deck stringer tubes 42. In another alternative, these retainer bars 62 can be welded directly to the existing deck stringer tubes.

Referring again initially to FIG. 18, a plurality of individual mushroom-shaped screen panel retainers, each generally at 80, are secured, spaced from each other, along an upper generally horizontally oriented planar surface 82 of the retainer bar 62. Each such mushroom-shaped screen panel retainer, generally at 80, has, as is depicted in FIG. 18 and as may also be seen in FIG. 5, a mushroom-shaped head 86, a head shank 88, and a head pin 90. Each such mushroom-shaped screen panel retainer 80 may be a separate metal member which is attached, typically by welding, to the upper horizontally oriented planar surface 82 of the retainer bar 62 of the first embodiment of the screen panel retainer assembly, generally at 60. Each mushroom-shaped retainer head pin 90 is sized to be receivable in a cooperatively shaped head pin receptacle 92 which is formed in the upper surface 82 of the retainer bar 62. The metal mushroom-shaped retainers 80 are preferably permanently attached, by welding, bolting, or the like, to the upper surface 22 metal retainer bar 62. It is also possible to cast or to otherwise form the retainer bar 62 and the mushroom-shaped screen panel retainers 80 as an integral unit, as is depicted schematically in FIG. 5.

As is visible, for example, in FIG. 18, each mushroom-shaped retainer, generally at 80, has its head top 86 configured generally as a semi-cylinder with a longitudinal axis of the semi-cylinder extending in the direction of slurry flow. A head top upper surface 94 is formed as a section of a right cylinder and has a generally uniform radius of curvature. A head top lower surface 96, which is essentially a diameter of the cylinder, extends generally transversely to a longitudinal axis of each such mushroom-shaped retainer head top 86 and transversely to the material flow direction along the screen panels. The head top 86 is symmetrical with respect to the head shank 88 and extends transversely to both sides of that shank 88.

As may also be seen most clearly in FIG. 18, the mushroom-shaped screen panel retainers, generally at 80, are secured to the upper surface 82 of the retainer bar 62 in a non-uniform longitudinal pattern. The purpose of this non-uniform longitudinal pattern or positioning will be discussed in greater detail in a subsequent section. As seen in FIG. 18, preferably two of these mushroom-shaped screen panel retainers, generally at 80, are placed in the space along the retainer bar 62 which is between two of the retainer bar studs 64. This spacing is chosen to facilitate the selective attachment of the urethane screen panels 72 or of the profile wire screen panels 26 to the vibrating separatory machine, as will now be discussed in detail.

Referring again to FIG. 1, the first variation of the vibrating separatory machine, which is depicted generally at 20, has an array of six urethane screen panels 22 attached side-by-side across its width and has sixteen such urethane screen panels 22 spaced along its length. While this is a depiction of a typical vibrating separatory machine, it will be understood that other sizes of machine, with other sizes of urethane screen panels are all within the scope of the present invention.

As depicted, each of the urethane screen panels 22 is 1'×1' and is defined by a leading panel edge 100, a trailing panel edge 102, a right panel side 104, and a left panel side 106. The panels are attachable to the deck of the vibrating separatory machine by the use of the mushroom-shaped screen panel retainer assembly, generally at 60. The individual urethane screen panels 22 are secured to the deck of the vibrating separatory machine so that they form an unobstructed surface across which, and along which, the slurry to be separated can flow. If desired, the panels can be provided with integral cross dams, as depicted in FIG. 10, and as will be described subsequently.

Figure 3:
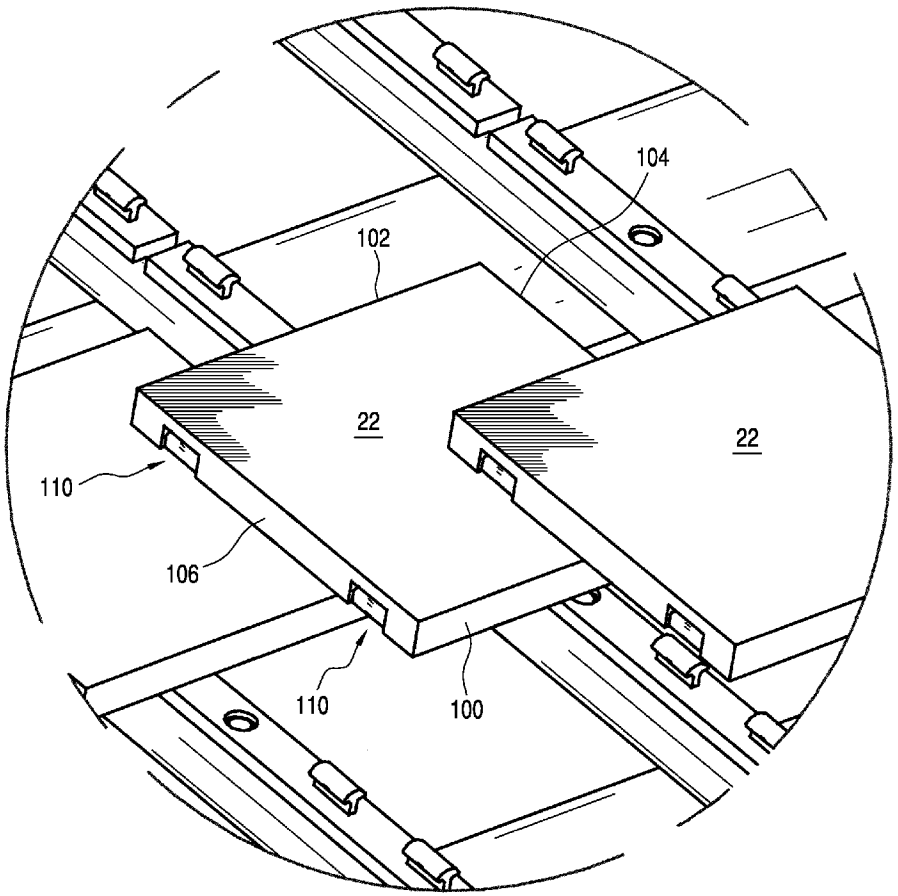
FIG. 3 is an enlarged perspective view of an encircled portion B of the device depicted in FIG. 1.

Each urethane screen panel has, on its right and left panel sides 104 and 106, spaced mushroom-shaped retainer receiving chambers 110. As may be seen in FIG. 3, each such mushroom-shaped retainer receiving chamber 110 is sized and of a shape to receive one-half of a head and shank of a complementarily shaped mushroom-shaped retainer 80. Each such chamber 110 is formed in the urethane sides 104 and 106 of its respective urethane screen panel. As may be seen in FIG. 2, when two of the urethane screen panels are placed beside each other, their cooperating chambers 110 will be so sized and shaped as to snugly receive and capture ones of the mushroom-shaped retainers 80 that are cooperatively spaced along the length of the retainer bar 62. Since the mushroom-shaped retainers 80 and their supporting retainer bar 62 are metal, and since the urethane panels, including their right and left panel sides 104 and 106 are plastic, the urethane panel edges can deform sufficiently to retain and to capture the mushroom-shaped retainer heads 86 and their supporting shanks 88. The lateral side panels 30 and 32 of the vibrating separatory machine are provided with wedge plates, generally at 114, whose function, in securing the outer sides of the laterally outermost urethane panels in place, is well known and is discussed in several of the assignee's prior patents.

In application, the first embodiment 60 of the screen panel retainer assemblies, in accordance with the present invention, are bolted to the spaced deck stringer tubes 42. Once all of the deck stringer tubes 42 have been provided with their respective screen panel retainer assemblies 60, the individual urethane screen panels 22 can be installed. As was discussed above, the cooperative shapes of the metal mushroom-shaped retainer heads 86 and the shapes of the chambers 110 in the side walls of each of the resilient urethane panels 22 allows the panels to be snapped into place and to be held firmly, yet removably, on the deck of the vibrating separatory machine. As is visible in FIG. 3, the chambers 110 are located in the panel sides 104 and 106 generally adjacent the intersections of the panel sides 104; 106 with the panel ends 100 and 107. These placements are at the areas where the urethane panels would be subjected to the greatest lifting forces and are chosen to maximize the retentive forces exerted by the mushroom-shaped retainers 80 on the panels. It is within the scope of the present invention to provide additional discrete mushroom-shaped retainers 80 along the length of the retainer bar upper surface 82. However, the configuration depicted and described above has been utilized successfully to hold the urethane screen panels to the machine deck securely yet so that they can be removed, as needed. In the preferred embodiment depicted in FIGS. 1-3, the mushroom-shaped retainers 80 each have a length of generally about 1-½ inches and a width of about ¾ inch. Each mushroom-shaped retainer 80 has a height above the upper surface 82 of its respective retainer bar of ¾ inch. The resultant urethane screen panel assemblages on the deck of the vibrating separatory machine, using the first preferred embodiment 60 of the screen panel retainer assembly in accordance with the present invention, is planar, with no protrusions that would impede the flow of the slurry to be separated. The panels are securely attached, but can be removed quickly and easily.

Turning now to FIGS. 6-9, there may be seen the use of the first preferred embodiment of the screen panel retainer system, generally at 60 and in accordance with the present invention, to secure profile wire screen panels, generally at 26, to the deck of a vibrating separatory machine 24. It is quite possible that the deck of the vibrating separatory machine 24 depicted in FIG. 6 is the same as the deck of the vibrating separatory machine depicted at 20 in FIG. 1. The only difference may be that the machine depicted in FIG. 6 is being used with profile wire screen panels 26 whereas the one depicted in FIG. 1 is being used with urethane screen panels 22. The screen panel retainer assembly, generally at 60, as discussed in connection with FIG. 1, is the same, in structure and function, as is its counterpart depicted and to be discussed in connection with the vibrating separatory machine 24. The sole essential difference is the type and structure of the panels secured to each deck by the same first embodiment of the screen panel retainer assembly 60.

Figure 9:
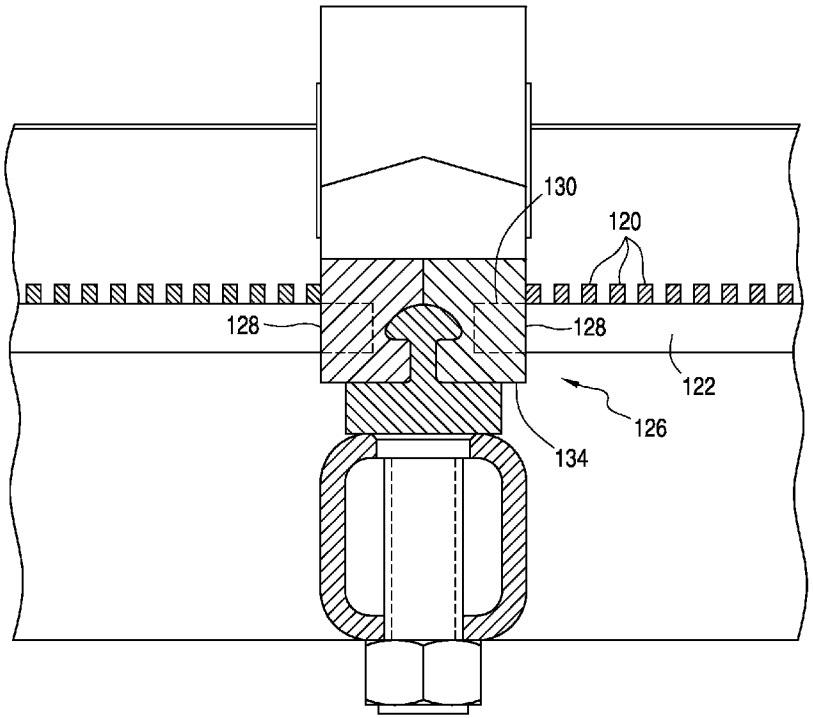
FIG. 9 is an end view of a portion of the machine deck of FIG. 6 and showing a profile wire screen panel held in place by the first embodiment of the screen panel retainer system in accordance with the present invention.

Profile wire screen panels, such as the one depicted generally at 26 in FIG. 6, are generally known in the art. Such screen panels are described in detail in assignee's prior U.S. Pat. No. 6,964,341, for example. As may be seen in FIG. 6, each such profile wire screen panel, generally at 26, is approximately 1 foot wide and may be, for example, 4 or 6 feet in length. Each profile wire screen panel, as is depicted in FIG. 9, is comprised of a plurality of spaced, parallel profile screen wires 120, each of which is welded to several spaced transverse tie rods or tie bars 122. It will be understood that the generally rectangular cross-sectional shape of each of the profile screen wires 120 depicted in FIG. 9 is schematic in nature. In actual usage, these profile screen wires may have an inverted trapezoidal shape and their spacing, one from the other, is determined by the size of the particles that are to be separated. The profile screen wires extend along the machine deck in the direction of flow while the tie bars or rods 122 extend transversely to the direction of flow.

Each of the lateral sides of each such profile wire screen panel 26 is defined by what is typically a generally rectangular or square, in cross-section, screen panel edge strip, generally at 126. A portion of one such edge strip 126 can be seen more clearly in both of FIGS. 7 and 8. These profile wire screen panel edge strips 126 are provided, on their inner side wall 128, with pockets, that are depicted in dashed lines at 130 in FIG. 9. These pockets 130 receive the ends of the transversely extending tie rods 122 and are sized and positioned to cooperate with those tie rod ends.

Each of the profile wire screen panel edge strips 126 is formed of a somewhat resilient yet durable plastic. For example, each such edge strip 126 can be formed of an ultrahigh molecular weight plastic (UHMW). Each such edge strip has an outer side wall 132 which is formed with spaced mushroom-shaped retainer head and shank receiving chambers, generally at 140. Each such chamber 140 is formed, in its respective panel edge strip 126 outer side wall 132, in a shape that is complementary to one-half of a mushroom-shaped screen panel retainer head, generally at 86. In this respect, the urethane panel lateral sides 104 and 106 and the profile wire screen panel edge strip outer surface 132 are provided with essentially the same chambers 110 and 140, respectively. Each such chamber 110 or 140 has a shape which will envelop one-half of each of the longitudinally spaced mushroom-shaped screen panel retainer heads 86 and shanks 88 that are situated spaced along the upper surface 82 of the retainer bar 60 depicted more clearly in FIG. 18.

As may be seen in FIG. 6, each of the profile wire screen panel edge strips 126 can be provided with eight of the mushroom-shaped screen panel retainer head and shank receiving chambers 140 spaced along its outer side 132. Since the vibrating separatory machine 24 may be usable with either urethane panels 22, as seen in FIG. 1, profile wire screen panels 24, as seen in FIG. 6, or a combination of both, as seen in FIG. 10, the spacing between successive ones of the mushroom-shaped screen panel retainer head and shank receiving chambers 110 or 140 must be the same for all three applications. Since each profile wire screen panel may be four times as long as one of its urethane screen panel counterparts, there will be more mushroom-shaped screen panel retainer head receiving chambers 140 formed along each of the edge strips 126 for each of the individual profile wire screen panels. However, the spacing between individual ones of the chambers 110 or 140 remains the same in either instance.

The profile wire screen panels, generally at 26, are attached to the machine deck of their respective vibrating separatory machine in the same way as were the urethane screen panels. Each of the lateral side panels 30; 32 of the vibrating separatory machine depicted at 24 in FIG. 6 has spaced wedge plates 114 along the inner surface. These wedge plates 114 are used in the same manner, in each type of panel securement, and act to retain the outermost edge strips of the outermost profile wire screen panels in place. When the outer profile wire screen panels 22 are positioned on the machine deck of the vibrating separatory machine 24, their laterally inner edge strips 126 will be supported, by their lower walls 134, on the upper planar surface 82 of the elongated, generally horizontally oriented retainer bar 62. The mushroom-shaped wire panel retainer head receiving chambers 140 on two laterally aligned panel edge strips 126 will encompass the cooperatively placed retainer heads 86 and shanks 88 that are spaced longitudinally along each retainer bar. Such an encompassment of one such mushroom-shaped retainer head 80, by the chambers 140 formed on two abutting edge strips 126 of two laterally adjacent profile wire screen panels 24, can be seen most clearly in FIG. 9.

Figure 7:
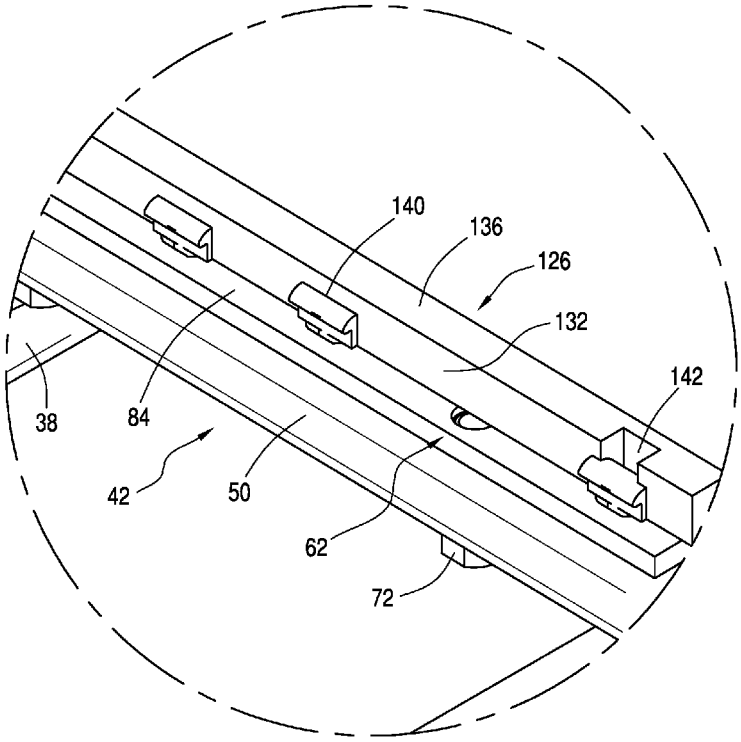
FIG. 7 is an enlarged perspective view of the encircled portion F of FIG. 6.
Figure 8:
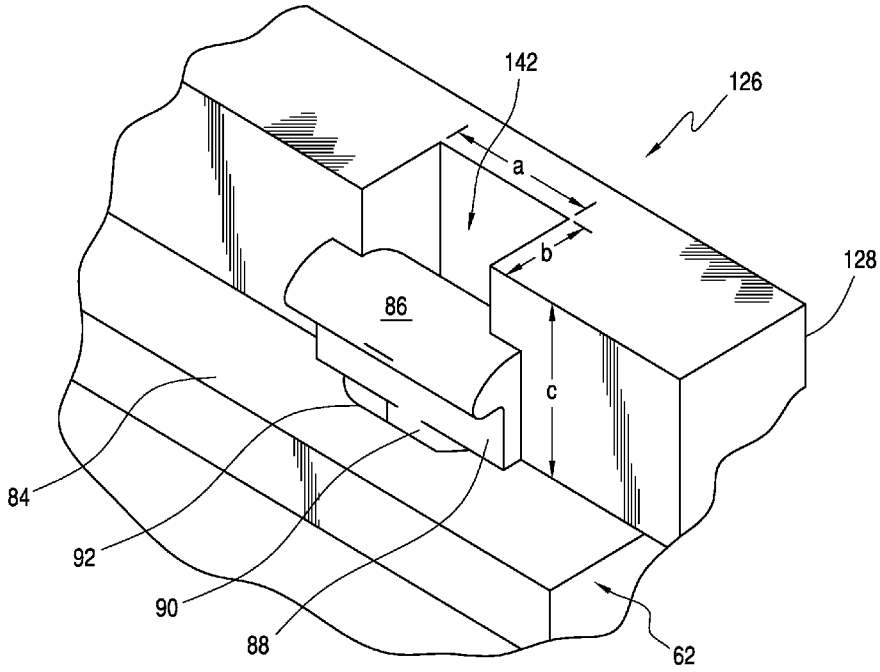
FIG. 8 is an enlarged perspective view of a portion of FIG. 7.

Referring to FIG. 7, it will be seen that intermediate ones of the mushroom-shaped retainer head receiving chambers 140, for each profile wire screen panel, are not open to the upper surface 136 of each of the profile wire screen panel edge strips 125. However, end ones of these chambers 140, do have a generally rectangular cut-out 142. Each such cut-out 142, as may be seen more clearly in FIG. 8, has a length "a" that is less than a corresponding length of a mushroom-shaped retainer head 86. It also has a width "b" that is greater than the associated width of one-half of the associated head 86. Further, each cut-out 142 has a depth "c" which is preferably the same as that of the height of the profile wire screen panel edge strip. As will be discussed shortly, these cut-outs 142, which are formed as part of the mushroom-shaped head retainer chambers 140, and which are situated generally at the side of each of the screen panels and adjacent to its ends, are provided for the purpose of facilitating the attachment of dam retainers to the upper surfaces of the profile wire screen panels 24.

The use of cross dams on vibrating separatory machines is generally well known in the art. Such cross dams, such as the ones depicted generally at 150, are placed across the surface of the screen panel deck of vibrating separatory machines, and particularly across the deck of such a machine equipped with profile wire screen panels 24. These cross dams act to disrupt what may become a somewhat laminar flow of the slurry along the surface of the screen deck. Separation of the slurry is better accomplished by the formation of turbulent flow in the slurry. The cross dams accomplish this purpose. They are also effective in sealing the abutting ends of two sequentially situated, longitudinally extending profile wire screen panels 26. Since these panels 26 are each made of individual profile screen wires, the junction of one such panel's screen wires with the screen wires of the next longitudinally adjacent screen panel may not be exact.

Figure 11:
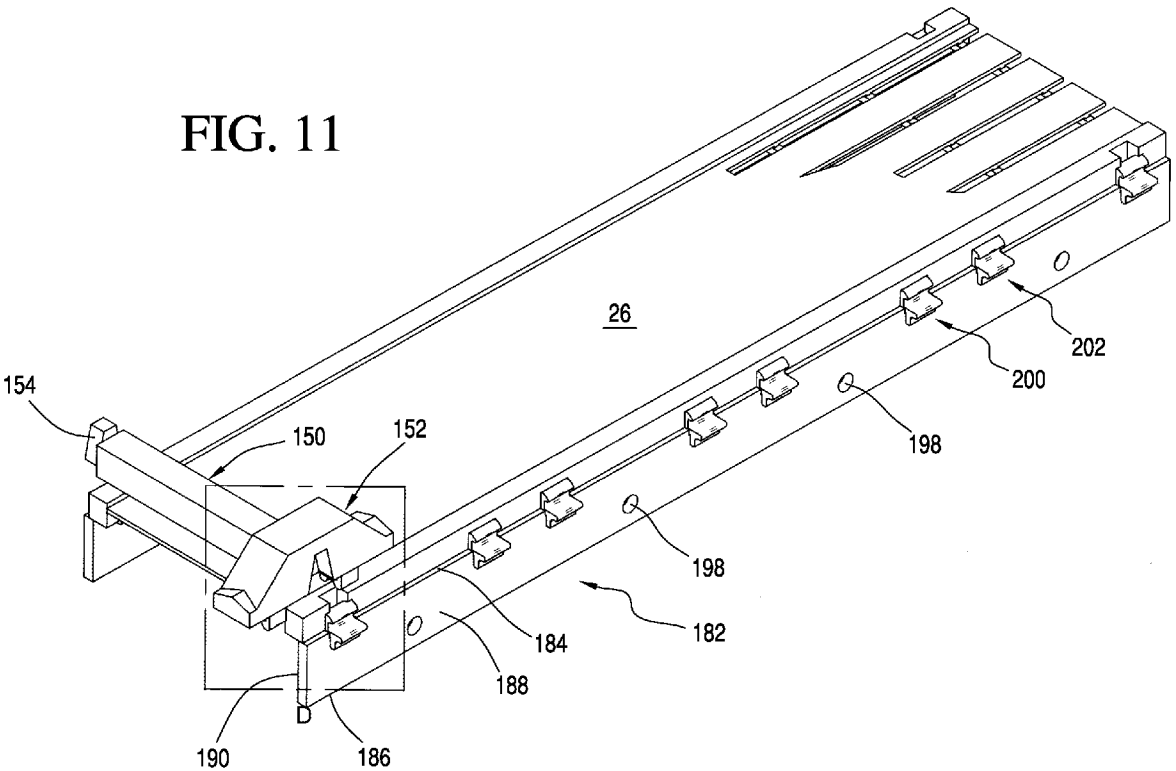
FIG. 11 is a perspective view of one of the profile wire screen panels of FIG. 9 and showing the second preferred embodiment of the screen panel retainer system with a cross dam and a dam retainer.

One such cross dam 150, and one of its cooperating dam retainers 152, may be seen most clearly in FIG. 11. Each cross dam 150 is sized to extend across the width of its associated screen panel 24. Each such cross dam 150 is preferably formed of a metal strip or tube that is then coated with a resilient material that may be the same as the polyurethane plastic that is used to form profile wire screen panel edge strips 126. Each such cross dam 150 has a cross dam key 154 formed at each end. Each such cross dam key 154 is generally trapezoidal and is sized to cooperate with a similarly shaped keyway 156 in each of two laterally spaced side surfaces 158 and 160 of each dam retainer 152.

Figure 12:
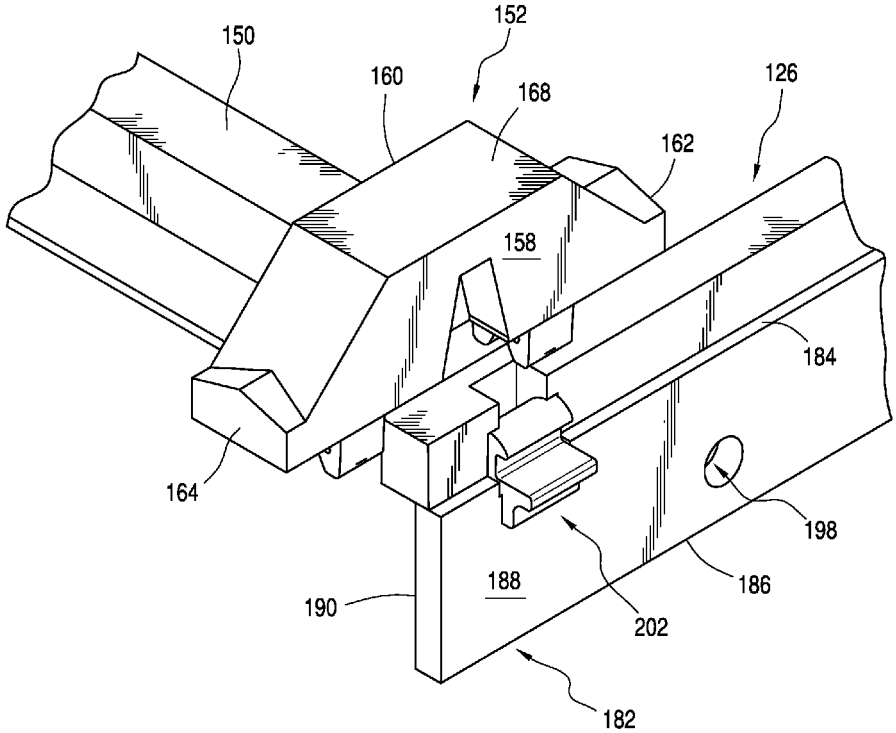
FIG. 12 is an enlarged perspective view of the delineated section of FIG. 10.
Figure 13:
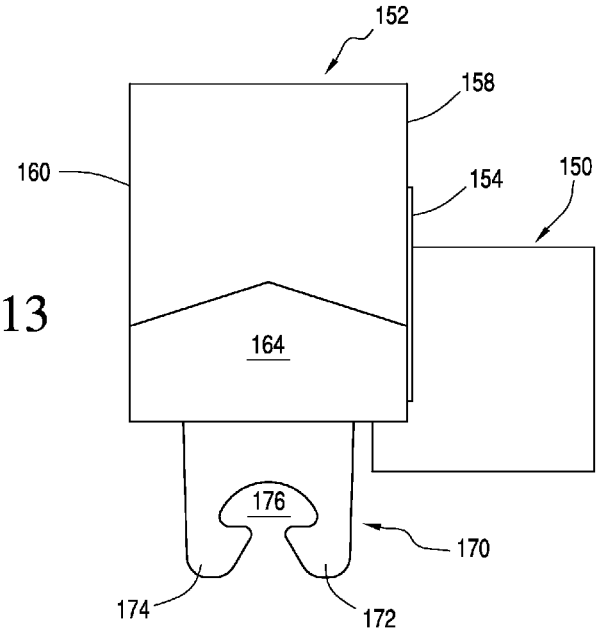
FIG. 13 is an end view of a portion of a cross dam and a dam retainer in accordance with the present invention.
Figure 14:
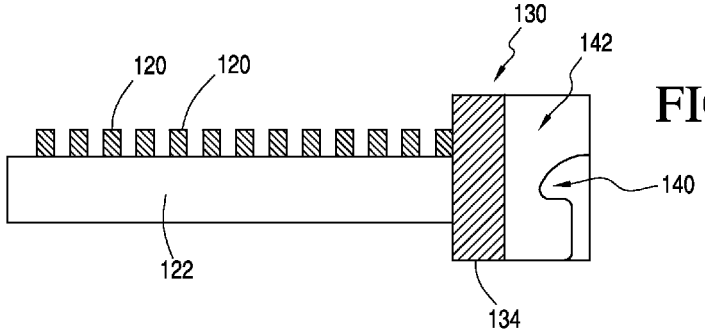
FIG. 14 is a cross-sectional view of a portion of a profile wire screen panel and end strip or bar of the present invention.
Figure 16:
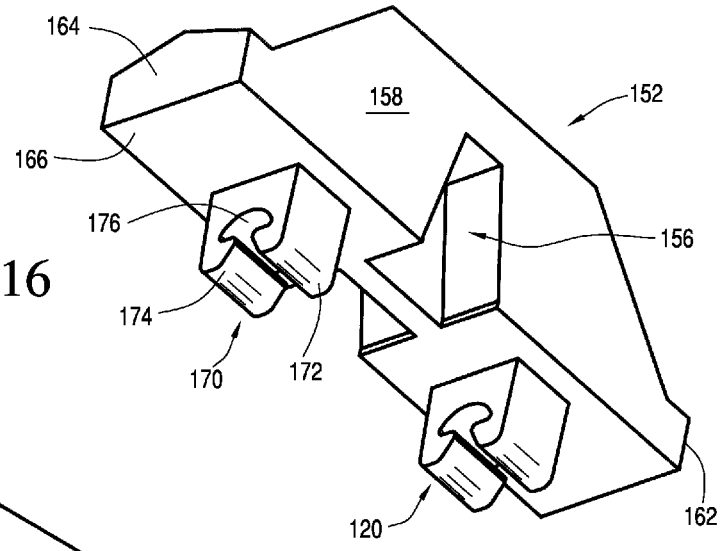
FIG. 16 is a perspective view, from below, of a preferred embodiment of a dam retainer in accordance with the present invention.
Figure 17:
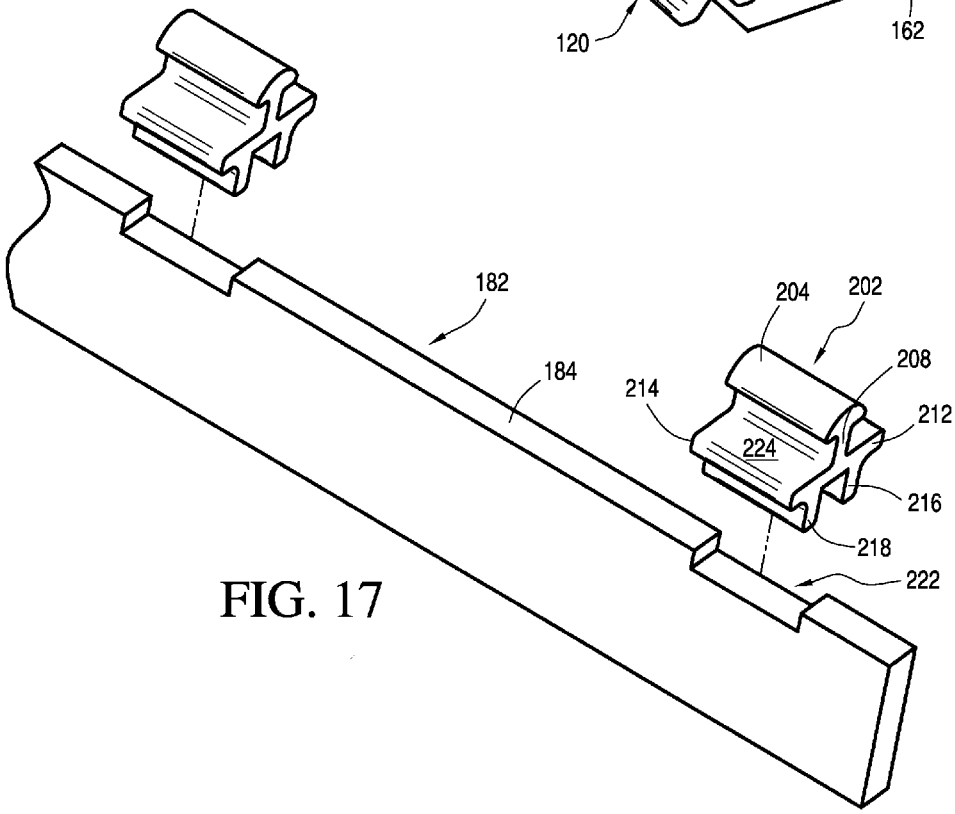
FIG. 17 is an exploded perspective view of a portion of the second preferred embodiment of the screen panel retainer system in accordance with the present invention.

Each of the dam retainers 152, as may be seen perhaps most clearly in FIGS. 12 and 16, has, in addition to its two lateral sides 158 and 160, a pair of spaced dam retainer ends 162 and 164, a dam retainer base surface 166 and a dam retainer top 168. Each such dam retainer 152 has a somewhat trapezoidal shape in side elevation. It is preferably formed using the same polyurethane plastic as is used in the formation of the profile screen wire panel edge strips.

As is depicted in FIG. 16, for example, each such dam retainer 152 is formed with a pair of horizontally spaced, mushroom-shaped screen panel retainer engaging feet 170. Each such dam retainer foot is bifurcated into two toes 172 and 174 which define between them a dam retainer chamber 176. Each such dam retainer chamber 176 is shaped so that it will engage one of the mushroom-shaped heads 86 and shanks 88 of the screen panel retainer assembly 60. As may be seen in FIG. 11 and perhaps more clearly in FIG. 12, the toes 172; 174 of the dam retainer foot 170 are sized to fit into the cut-outs 142 in the profile wire screen panel edge strip 126 which is formed at either end of each such edge strip 126. Since the length "a" of the cut-out is less than the length of the associated mushroom-shaped screen panel retainer head 86 and its receiving chamber 140 in each end of each profile wire screen panel edge strip 126, the retainer heads 86, which are engageable with the profile wire screen panel edge strips and with the toes of the dam retainers 152, are long enough to secure both the panel edge strips 126 and the dam retainer toes 172; 174.

Once the profile wire screen panels 24 have themselves been positioned on the vibrating separatory machine's deck, as was discussed above, the cross dams 150 are positioned at the junctions of each two longitudinally spaced panels, as may be seen in FIG. 6. The cross dams 150 rest on the tops of the profile wire screen panels. Their cross dam keys 152, which are formed at the ends of each such cross dam 150, are each sized and positioned to slide into a cooperating dam retainer keyway 156. As the dam retainers are pushed down over the cross dam keys 154, the dam retainer bifurcated feet 170 slide into the cut-outs 142 that have been provided in the profile screen wire panel edge strips 126. Once the dams 150 and dam retainers 152 have been so assembled, the upper surface of the vibrating separatory machine is completed. The cooperation of the mushroom-shaped screen panel retainer heads, the underlying supporting retainer bars, the chamber 140 formed in the panel edge strips 126, and the arrangements of the cross dams 150 and dam retainers 152 presents a rugged, durable attachment or securement assembly that is clean, dependable, secure, and that allows the associated screen panels, either urethane or profile screen wire to be attached to a vibrating separatory machine.

Figure 10:
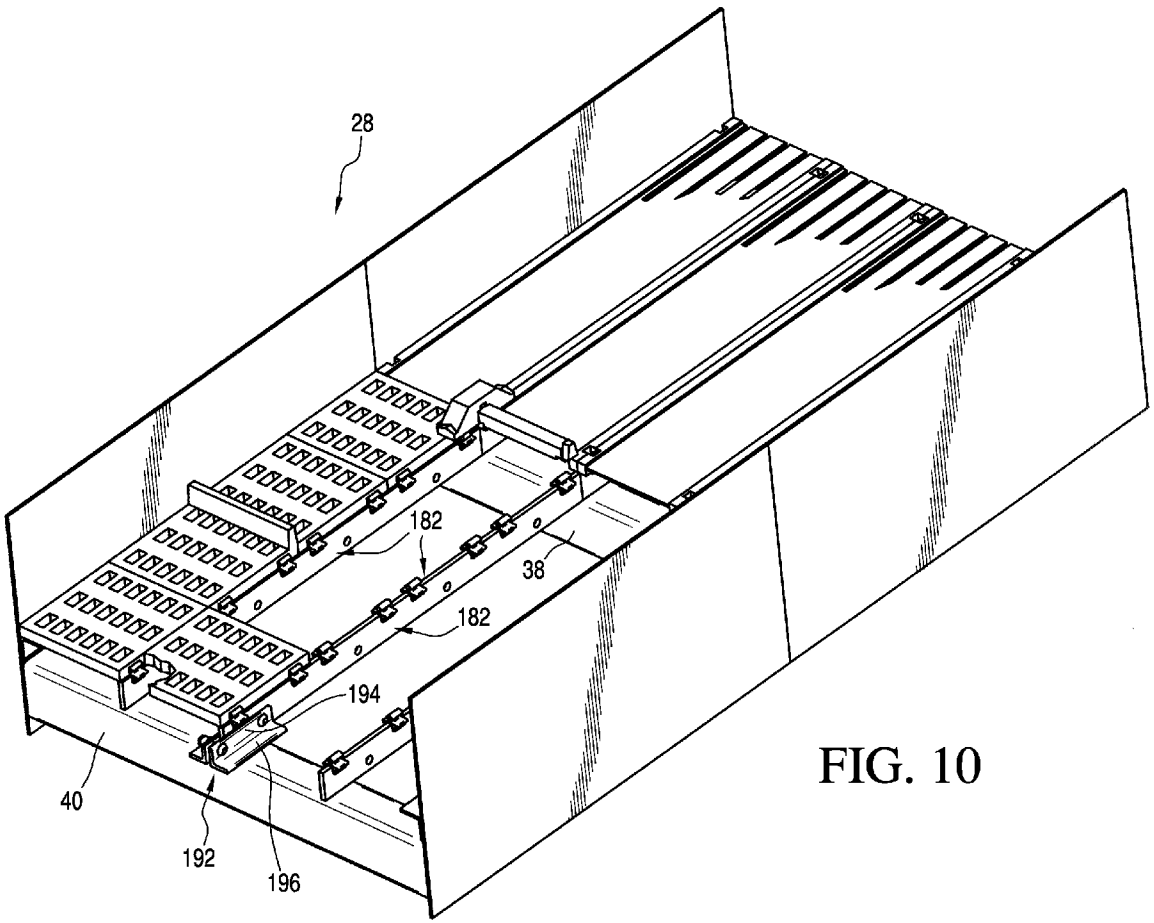
FIG. 10 is a perspective view of a third preferred embodiment of a vibrating separatory machine and showing a plurality of profile wire screen panels and urethane screen panels secured to a machine deck using a second preferred embodiment of the screen panel retainer system in accordance with the present invention.

The vibrating separatory machine may support only urethane panel 22, may support only profile wire screen panels 26, or, as is depicted in FIG. 10, may support some of both types of screen panels 22 and 26. The specific separatory panels to be used in a particular application is a function of the type of material to be separated and the type or types of panels that will best accomplish that separation. If it is appropriate to include cross dams in an assembly of urethane screen panels, those dams can be molded integrally with the panels. Alternatively, the cross dams could be secured to urethane panels whose panel edges would be modified to provide cut-outs similar to those described in connection with the profile wire screen panels 26.

In the discussion of the screen panel retainer system, in accordance with the present invention, as has been set forth above, the mushroom-shaped screen panel retainers, generally at 80, have been welded or otherwise attached to an upper generally planar major surface 82 of a retainer bar 62. That retainer bar 62 has been bolted, welded, or otherwise attached to an upper surface of each of the spaced deck stringer tubes 42, which are, in turn, affixed on the upper surfaces of machine cross frame tubes 38. It may be referred to as a deck stringer tube retainer bar. As will now be described, in a second preferred embodiment of the present invention, and as is depicted in FIGS. 10-12, 15, and 16, the equivalent retainer bar, now generally at 182, is rotated 90° from its prior orientation and is attached, not to deck stringer tubes, but instead is attached to the underlying machine cross frame tubes 38 and machine end cross frame tubes 40. Since these retainer bars 182 are attached to the machine frame deck of the vibrating separatory machine, they can also be referred to as machine frame retainer bars 182 instead of the deck tube retainer bars 62 that were described previously. In either embodiment, the retainer bars, whether they are deck stringer tube retainer bars or deck machine frame retainer bars are provided with spaced mushroom-shaped screen panel retainers that are spaced and sized to be received in complementary chambers in the edges of the urethane panels or the profile screen wire panels.

Referring again to FIG. 10, each deck machine frame retainer bar 182 is securable to the longitudinally spaced deck machine cross frame tubes 38 and deck machine end frame tubes 40 in one of several different ways. As is seen in FIG. 11, each such deck machine frame retainer bar 182 has an upper edge 184, a lower edge 186, and right and left generally planar side walls 188 and 190; respectively. As discussed above, the orientation of each such deck machine frame retainer bar 182 is essentially 90° different from that of the deck stringer tube retainer bar 62. This is necessary to insure that the location of the screen panels 22 and/or 26 which are attached to the vibrating separatory machine 28 depicted in FIG. 10, and specifically their height, is the same as they would be when they are attached to the machines shown generally at 20 and 22. Since, in the third structure of the vibrating separatory machine, as seen in FIG. 10, there are no intermediate deck stringer tubes 42, the height of the deck machine frame retainer bars 182 must be the same as was the combined height of the deck stringer tubes 42 and their supported deck stringer retainer bars 62.

Referring again to FIG. 10, the deck machine frame retainer bars 182 can be attached to the plurality of machine cross frame tubes 38 and to the machine end frame tubes 40, either directly, or by being attached to intermediate angle clips 192. The angle clips 192 are each configured as a short length of angle iron having a vertical web 194 and a horizontal flange 196. Two such angle clips 192 are secured to the machine cross frame tube 38 or to the machine end frame cross tube 40 by welding of their respective flanges 196 to the upper surface of each such cross tube. The two angle clips 192 in each pair of angle clips are spaced laterally sufficiently to accommodate a deck machine frame retainer bar 182. The lateral spacing between the cooperating angle clips 192 in each such pair of angle clips is thus just slightly greater than the thickness of the deck machine frame retainer bar 182. As was discussed above, the height of the deck machine frame retainer bar 182 is selected so that its upper edge 184 will be located at essentially the same height as would the upper surface 82 of the deck stringer tube retainer bar 62. Clearly, this is necessary to insure that the screen panels 22 and/or 26, that will be secured to the mushroom-shaped screen panel retainers 80, which are affixed to either the deck stringer retainer bar 62 or the deck machine frame retainer bar 182, are at the appropriate height to cooperate with the wedge plates 114 that are attached to the lateral side panels 30; 32 of the vibrating separatory machine.

As may be seen in FIG. 10, a combination of angle clips 192 and direct welding of the lower edges 182 of the deck machine frame retainer bars 182 to the machine cross frame tubes 38 and/or to the machine end cross frame tubes 40 can be accomplished. If the deck machine frame retainer bars 182 are to be welded directly the upper surfaces of the machine cross frame tubes 38 and the machine end cross frame tubes 40, this can be accomplished by using any well-known welding technique that is compatible with the type of metals being used. If the deck machine frame retainer bars 182 are to be secured to angle clips 192, this can be done by providing suitably spaced, transverse bores 198 in the major side walls 188; 190 of the deck machine frame retainer bar 182. These transverse bores 198 will obviously be located to align with similar bores, not specifically depicted in FIG. 10, to facilitate the securement of the deck machine frame retainer bars 182 to the angle clips 192 by suitable bolts 200. The deck machine frame retainer bars 182 could be attached to the angle clips 192 either before or after the angle clips 192 are secured to the respective machine cross frame tubes 38 and/or each machine cross frame tubes 40. The deck machine frame retainer bars 182 could also be welded to the angle clips 192 before the angle clips 192 are then welded to the machine cross frame tubes 38 and/or to the machine end frame tubes 40.

Figure 15:
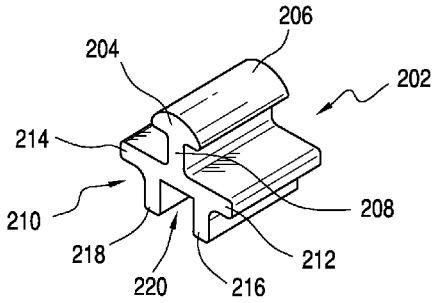
FIG. 15 is a perspective view of a mushroom-shaped retainer head and support assembly in accordance with the second preferred embodiment of the present invention.

As may be seen most clearly in FIG. 11, a plurality of mushroom-shaped screen panel retainers, each generally at 202, are individually secured to the upper edge 184 of the deck machine frame retainer bar 182. A single, representative one of these mushroom-shaped screen panel retainers, generally at 202, is depicted in FIG. 15. Each such mushroom-shaped screen panel retainer 202 has a retainer head 204 whose retainer head top 206, as was the previously described in connection with retainer head top 86, is formed as a portion, and specifically is formed as a half of a right cylinder, and with a longitudinal axis of the right cylinder extending in the flow direction of the slurry to be separated into its two constituents. The head 204 is provided with a downwardly extending head shank 208 which, in this embodiment, terminates at a low end, in a screen panel retainer saddle, generally at 210. The saddle 210, in turn, defined by a pair of transverse saddle ledges 212; 214 and a pair of spaced saddle legs 216; 218. The saddle ledges and legs cooperate to define a saddle slot 220.

The saddle slot 220 is sized to cooperate with a saddle receiving notch 222 which is provided in the upper edge 184 of the deck machine frame retainer bar 182. The depth of each such saddle receiving notch 222 will be determined in concert with the thickness of the saddle ledges 212; 214 and the depth of the saddle slot so that saddle ledge upper surfaces 224 will be flush with the upper edge 184 of the deck machine frame retainer bar 182. As may be seen in FIG. 12, for example, it is important to provide a flush, planar surface for either the profile wire screen panel edge strip 126 or the sides 104; 106 of the urethane screen panel 22 to rest on. In the first embodiment of the screen panel retainer assembly, as seen at 60, the shanks 88 of the mushroom-shaped screen panel retainers 80 are situated such that the upper surface 82 of each associated rail retainer bar 60 will support its associated panel edge strips or sides.

Urethane screen panels, such as the one depicted at 22 in FIG. 1, for example, are typically 12"×12". Profile wire screen panels are typically 12"×48", with the longer dimension being in the direction of slurry flow, as seen in FIG. 6 and in FIG. 10. In both situations, the spacing of the mushroom-shaped screen panel retainers, which are of finite length, must be determined in conjunction with the spacing of the chambers 110 in the urethane panel side or the corresponding chambers 176 in the profile screen wire panel edge strips. In a typical application, the retainer spacing pattern alternates between a spacing of 2" and a spacing of 8". This alternating spacing is desirable to insure that the mushroom-shaped screen panel retainer heads are situated near the ends of each of the 12"-long urethane screen panels. If a vibrating separatory machine were to be used only with 12"×48" profile wire screen panels, the longitudinal or slurry flow direction spacing of adjacent ones of the mushroom-shaped screen panel retainers could be lengthened to, for example, an alternating spacing of 4" and 11" or of another similar pattern that will place a mushroom-shaped screen panel retainer head adjacent each end of each panel that is to be removably secured to the deck of the vibrating separatory machine.

The first preferred embodiment of the mushroom-shaped screen panel retainers 80, with their deck stringer tube retainer bars 82, is more apt to be utilized with older vibrating separatory machines that are configured with a plurality of deck stringer tubes. The specific attachment of the lower surface of each deck stringer tube retainer bar, to the upper surface of the deck stringer tube, can be accomplished in a fashion that is decided by the hole pattern, or the lack of a hole pattern, which exists on the deck stringer tubes 42. In newer machines, which tend to be ones that are not configured with deck stringer tubes but which have the underlying machine cross frame tubes and machine end cross frame tubes. It is more typical to utilize the second embodiment of the deck machine frame retainer bars, which may be either welded directly to the machine cross frame tubes and to the machine end cross frame tubes or may instead be bolted to the angle clips. In either instance, the upper retainer heads and their associated shanks are dimensioned so that they will be snugly and securely retained in the cooperatively shaped and positioned screen panel edge chambers. The result is a screen panel retainer system which is adaptable to various supporting machine deck configurations. It can be embodied for use with older machines that have deck stringer tubes or with newer machines that may not. It uses finite length, mushroom-shaped screen panel retainers with retainer heads, which are made of metal, and which are sized to fit into the screen rail chambers of two adjacent panels whose cooperating resilient component's chamber is complementary in shape to the mushroom-shaped screen panel retainer head. The result is a durable, uncomplicated retainer assembly that is adaptable to a wide variety of potential usages, that does not require a large number of varied components and that is a commercial advantage for its user.

While preferred embodiments of a screen panel retainer system, in accordance with the present invention, have been set forth fully and completely hereinbefore, it will be apparent to one of skill in the art that a number of changes in, for example, the vibrating drives for the separatory machine, the overall dimensions of the separatory machine, the use of various numbers and combinations of screen panels, and the like, could be made without departing from the true spirit and scope of the present invention which is accordingly to be limited only by the appended claims.

What is claimed is:

1. A screen panel retainer assembly for use with a vibrating separatory machine having a plurality of screen panels and comprising;

at least one metal retainer bar securable to a machine deck of said vibrating separatory machine and having an upper surface;

a plurality of spaced, upwardly projecting, finite length, metal mushroom-shaped screen panel retainers attached to said at least one retainer bar;

a screen panel retainer head forming an upper portion of each such mushroom-shaped screen panel retainer, each such screen panel retainer head having an arcuate head upper surface with a generally uniform radius of curvature and defining a section of a right cylinder and with a cylinder longitudinal axis of each arcuate head upper surface extending in a flow direction of a slurry to be separated by said vibrating separatory machine;

a head projecting above said upper surface of said at least one retainer bar and supporting each said mushroom-shaped screen retainer head spaced above said upper surface of said retainer bar; and means securing each said retainer bar to said machine deck.

2. The screen panel retainer assembly of claim 1, wherein said at least one retainer bar is removably securable to said machine deck.

3. The screen panel retainer assembly of claim 2, wherein said retainer bar is provided with a plurality of bolts spaced along a lower surface of said retainer bar, said bolts being securable to said machine deck.

4. The screen panel retainer assembly of claim 1, further including angle clips securable to said retainer bar and to said machine deck.

5. The screen panel retainer assembly of claim 1, wherein each said head shank extends downwardly from a center of said screen panel retainer head.

6. The screen panel retainer assembly of claim 1, wherein said at least one metal retainer bar has a major surface which is generally horizontal and wherein said plurality of said upwardly projecting metal mushroom-shaped screen panel retainers are positioned on said generally horizontal major surface.

7. The screen panel retainer assembly of claim 1, wherein said at least one metal retainer bar has a major surface which is vertical and terminates in upper and lower edge surfaces.

8. The screen panel retainer assembly of claim 7, wherein each said mushroom-shaped screen panel retainer has said screen panel retainer head, said head shank, and a saddle, said saddle being secured to said upper edge surface of said at least one metal retainer bar, said head shank being positioned intermediate said saddle and said screen panel retainer head.

9. The screen panel retainer assembly of claim 8, wherein said saddle includes saddle ledges extending transversely to said screen panel retainer head.

10. The screen panel retainer assembly of claim 9, further including spaced saddle legs extending downwardly from said saddle ledges and defining a saddle slot therebetween.

11. The screen panel retainer assembly of claim 10, wherein said saddle slot is sized to receive said upper edge of said at least one metal retainer bar.

12. The screen panel assembly of claim 3, wherein said bolts are spaced along said retainer bar to be receivable in cooperatively spaced holes in a deck stringer tube of the vibrating separatory machine.

13. The screen panel retainer assembly of claim 4, wherein said vibrating separatory machine deck includes machine cross frame tubes and further wherein said angle clips are securable to said machine cross frame tubes.

14. The screen panel retainer assembly of claim 1, wherein said screen panels are urethane screen panels having panel edges with spaced screen panel retainer head receiving chambers.

15. The screen panel retainer assembly of claim 1, wherein said screen panels are profile wire screen panels having resilient panel edge strips with spaced screen panel retainer head receiving chambers.

16. The screen panel retainer assembly of claim 1, further including cross dams and cross dam retainers, said cross dam retainers being adapted to engage said screen panel retainer heads.

17. The screen panel retainer assembly of claim 1 wherein said at least one metal retainer bar is securable to said machine deck by welding.

18. The screen panel retainer assembly of claim 8 wherein said saddle ledges support the screen panels.

19. The screen panel retainer assembly of claim 16 wherein said cross dams include dam keys and said cross dam retainers include keyways adapted to receive said keys.

20. The screen panel retainer assembly of claim 11 wherein said upper edge of said retainer bar has saddle slot securing notches.

* * * * *

UNITED STATES PATENT AND TRADEMARK OFFICE

CERTIFICATE OF CORRECTION

PATENT NO. : 8,281,934 B1
APPLICATION NO. : 13/049000
DATED : October 9, 2012
INVENTOR(S) : James D. Connolly It is certified that error appears in the above-identified patent and that said Letters Patent is hereby corrected as shown below:

Column 16, claim 1, in line 44, after "head" insert --shank--.

Signed and Sealed this
Ninth Day of April, 2013

Teresa Stanek Rea
*Acting Director of the United States Patent and Trademark Office*